US007285762B2

(12) United States Patent
Spencer

(10) Patent No.: US 7,285,762 B2
(45) Date of Patent: Oct. 23, 2007

(54) SEALING METHOD AND APPARATUS FOR OIL AND GAS WELLS

(76) Inventor: Homer L. Spencer, 220 Pump Hill Rise S.W., Calgary, Alberta (CA) T2V 4C8

( * ) Notice: Subject to any disclaimer, the term of this patent is extended or adjusted under 35 U.S.C. 154(b) by 1370 days.

(21) Appl. No.: 10/084,986

(22) Filed: Feb. 27, 2002

(65) Prior Publication Data

US 2002/0158064 A1 Oct. 31, 2002

Related U.S. Application Data

(63) Continuation-in-part of application No. 09/539,184, filed on Mar. 30, 2000, now Pat. No. 6,384,389.

(51) Int. Cl.
*H05B 6/10* (2006.01)

(52) U.S. Cl. ..... 219/635; 219/607; 166/60; 166/304

(58) Field of Classification Search ..... 219/635, 219/607, 161, 603, 611, 614, 615–617; 166/60, 166/304, 248, 66.5, 284, 285, 300, 302; 428/546, 428/559; 299/14; 405/131
See application file for complete search history.

(56) References Cited

U.S. PATENT DOCUMENTS 3,908,763 A * 9/1975 Chapman ..... 166/302
4,328,865 A * 5/1982 Hall ..... 166/302
4,538,682 A * 9/1985 McManus et al. ..... 166/304

FOREIGN PATENT DOCUMENTS

CA 2208197 12/1998

OTHER PUBLICATIONS

"Use of Pressure Activated Sealants to Cure Sources of Casing Pressure". Rusch, David W. et al. Society of Petroleum Engineers Paper 55996. 1999.

* cited by examiner

*Primary Examiner*—Quang Van
(74) *Attorney, Agent, or Firm*—John Russell Uren

(57) ABSTRACT

Apparatus and method for melting material in the annulus of an oil or gas well and thereby sealing the annulus to prevent shallow gas leakage and the like. Conveniently, the material is positioned within the annulus between the production and surface casing of the well and above the well cement. A heating tool is lowered into position and provides the necessary heat to melt the material. The heating tool may be removed following the sealing of the annulus.

15 Claims, 15 Drawing Sheets

SEALING METHOD AND APPARATUS FOR OIL AND GAS WELLS

CROSS-REFERENCE TO RELATED APPLICATION

This application in a continuation-in-part of application Ser. No. 09/539,184 filed Mar. 30, 2000 now U.S. Pat. No. 6,384,389.

INTRODUCTION

This invention relates to a method and apparatus for sealing oil and gas wells and, more particularly, to a method and apparatus for using various materials which can be injected into an annulus of an oil or gas well and thereafter heated to form a seal in the annulus between the production and surface casing.

BACKGROUND OF THE INVENTION

The leakage of shallow gas through the casing cement used in well completion is often a problem in oil and gas wells. Such leakage is generally caused by inherent high pressures in oil and gas wells and can create environmental problems and compromise well safety. This leakage most often occurs because of cracks or other imperfections that occur in the cement that is injected into the well during well completion procedures between the surface and production casings.

Techniques for preventing shallow gas leakage are disclosed in Rusch, David W. et al, "Use of Pressure Activated Sealants to Cure Sources of Casing Pressure", SPE (Society of Petroleum Engineers) Paper 55996. These techniques use the application of an epoxy sealing technique. One disadvantage in using the technique taught by Rusch et al is that high pressure differentials across the source of leakage are required.

There is disclosed and illustrated a method and apparatus for subterranean thermal conditioning of petroleum in oil wells in Canadian patent application 2,208,197 (Isted) which application was laid open in Canada on or about Dec. 18, 1998. This document teaches the use of an electrical induction technique to provide heat to oil, particularly high viscosity heavy oil and oil containing high proportions of wax. Electrical induction is thought to be a much preferred method to supply heat to oil within a well because of the combustibility of the hydrocarbon products. Further, the benefits of this technique over the previous steam application technique include the fact that the steam used may cause damage to the permeability of the reservoir. This change may adversely affect oil production.

The use of electrical induction by Isted which is disclosed in the above-identified '197 application, however, is not contemplated to be also useful for sealing an annular space between surface and production casing.

SUMMARY OF THE INVENTION

According to one aspect of the invention, there is provided a method for melting a material in an annulus between the surface and production casing of an oil or gas well, said method comprising positioning said material at a predetermined location in said annulus and applying heat to said material, melting said material by said application of said heat and terminating said application of said heat following said melting of said material thereby to allow said material to solidify within said annulus and to form a seal within said annulus.

According to a further aspect of the invention, there is provided an apparatus for melting material in an annulus between the production and surface casing of an oil or gas well, said apparatus comprising an opening to allow the injection of said material into said annulus and to assume a predetermined location within said annulus, heating apparatus to apply heat to said material at said predetermined location within said annulus and to melt said material within said annulus and a switch to initiate and terminate said application of said heat to said material.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 2:
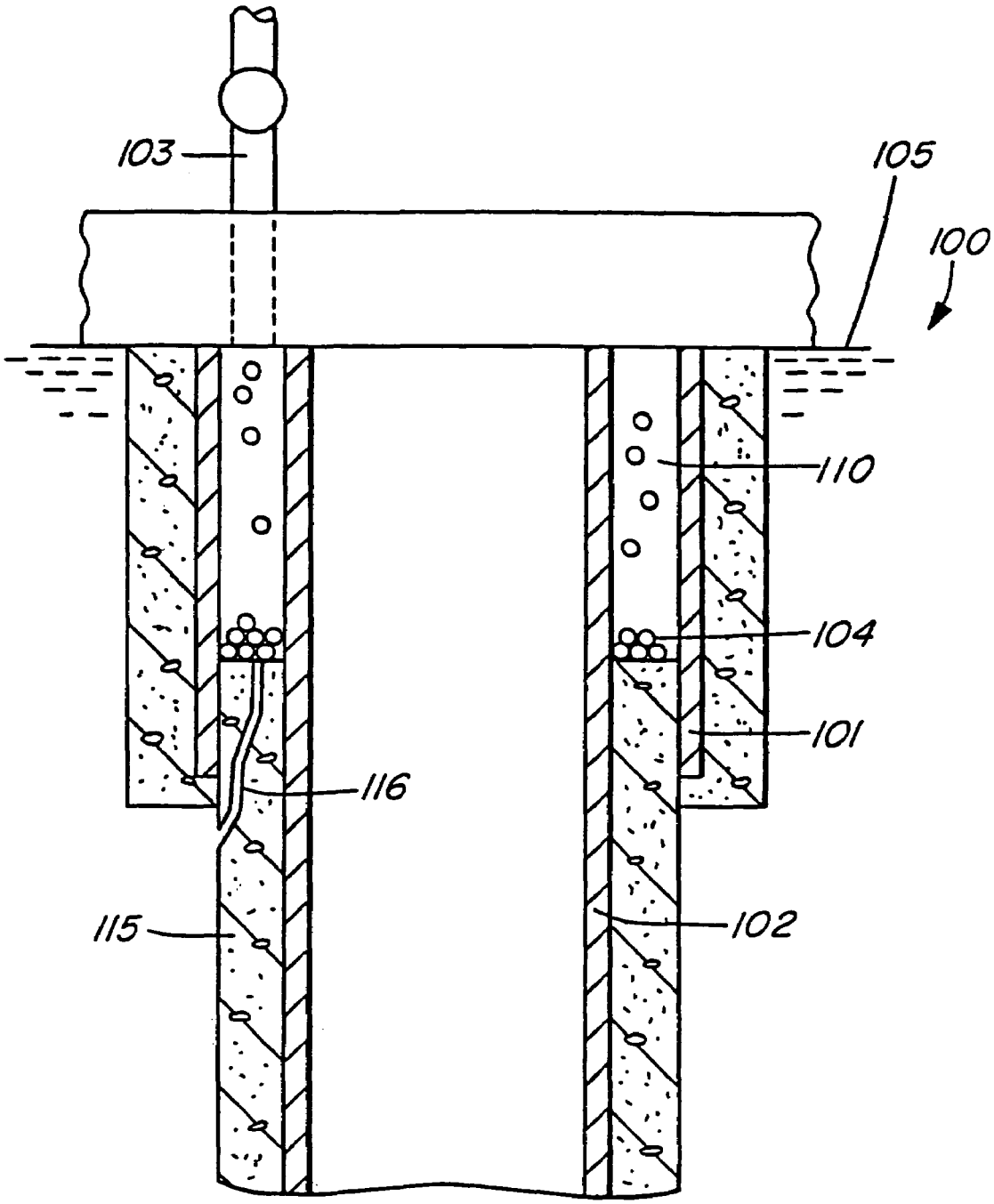
FIG. 2 is an enlarged diagrammatic cross-sectional view of an oil or gas well particularly illustrating the cement used in setting the production and surface casings relative to the metal used for sealing the annulus.
Figure 3:
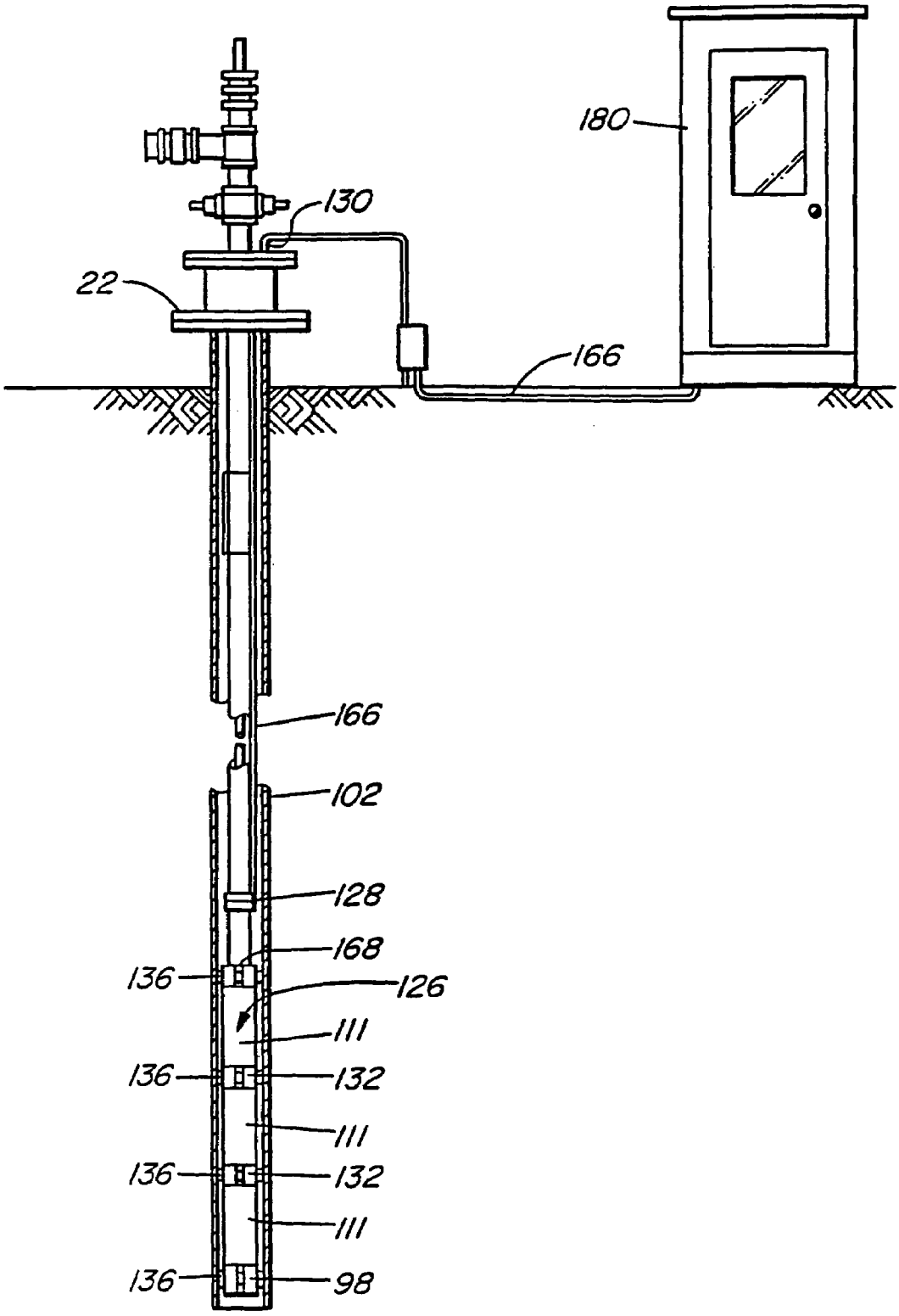
FIG. 3 is a diagrammatic side cross-sectional view of a magnetic induction assembly positioned in a vertical well and being in accordance with the present invention.

Referring now to the drawings, the surface and production casings of an oil or gas well generally illustrated at 100 are illustrated at 101, 102, respectively. The outside or surface casing 101 extends from the surface 105 (FIG. 2) of the formation downwardly and the production casing 102 extends downwardly within the surface casing 101. An annulus 110 is formed between the production and surface casings 101, 102, respectively. It will be appreciated that FIG. 2 is intended to diagrammatically illustrate an offshore well while FIG. 3 is intended to diagrammatically illustrate an onshore oil or gas well.

An injection port 103 extends downwardly from the surface into the annulus 110 between the surface and production casings 101, 102. The injection port 103 is used not only to inject certain fluids into the annulus 110 but is also used to carry small shot pellets 104 in the form of BB's which are poured into place via the injection port 103. The small shot pellets 104 are preferably made from an eutectic metal; that is, they have a relatively low melting point and can be liquified by the application of certain heat as will be explained. The injection port 103 further and conveniently may carry a suitable marker or tracer material such as radioactive boron or the like which is added to the shot 104 so that the location of the eutectic metal in the annulus 110 can be detected with standard well logging tools to ensure proper quantities of the metal being appropriate situated.

An electrical induction apparatus generally illustrated at 111 is located within the production casing 102. It may conveniently comprise three inductive elements 112, 113, 114 which are mounted on a wire line 120 which is used to raise or lower the induction apparatus 111 so as to appropriately locate it within the production casing 102 adjacent the shot pellets 104 following their placement.

The induction apparatus 111 will be described in greater detail.

More than one magnetic induction apparatus 111 (FIG. 3) may be used and they may be joined together as part of a magnetic induction assembly, generally indicated at 126. A magnetic field is induced in and adjacent to well casing 102 by means of the magnetic induction apparatus 111 thereby producing heat.

The magnetic induction assembly 126 includes an adapter sub 128, a electrical feed through assembly 130, and a plurality of magnetic induction apparatus 111 joined by conductive couplings 132.

Figure 4:
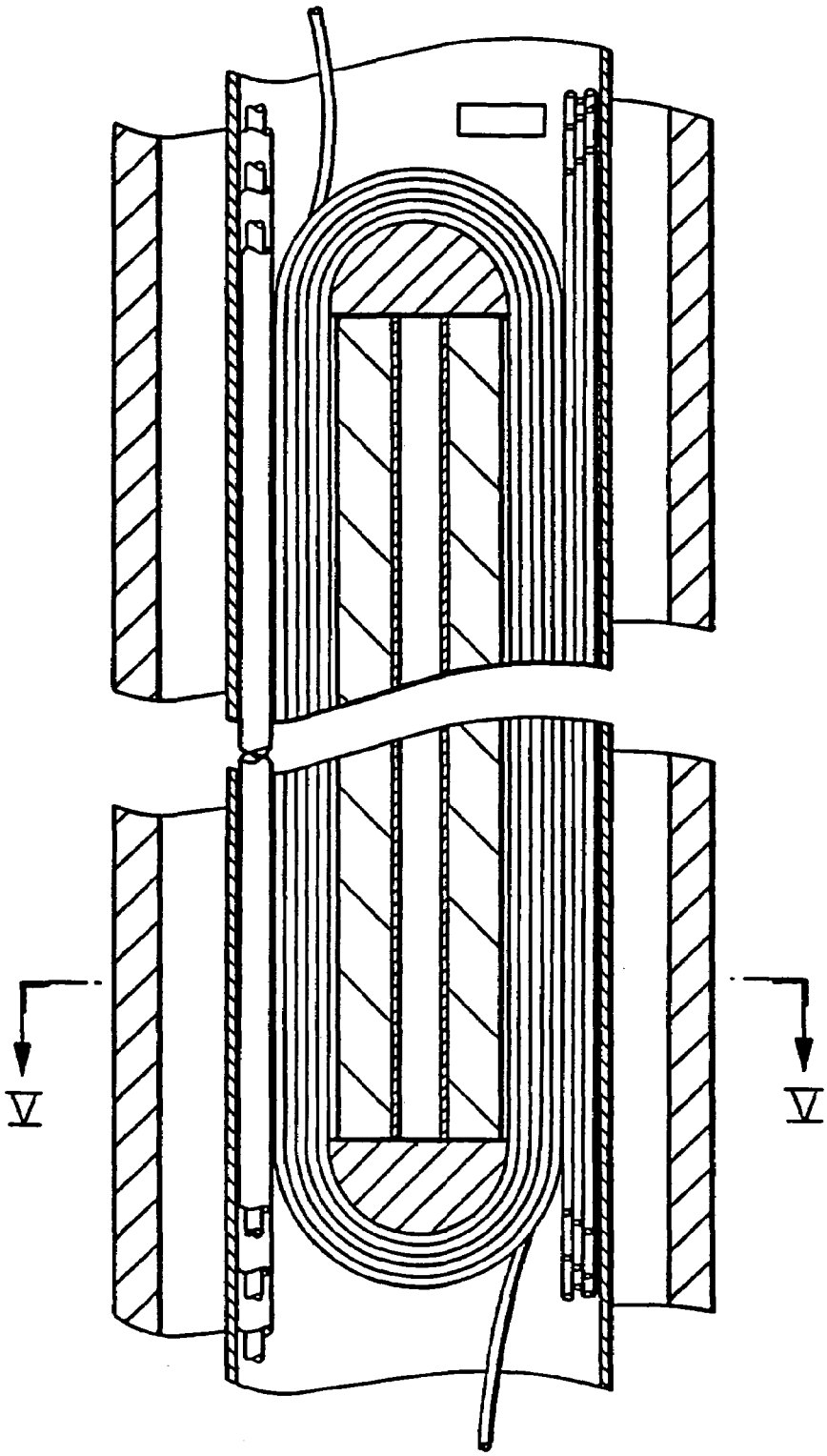
FIG. 4 is a diagrammatic side cross-sectional view of one of the magnetic induction apparatuses from the magnetic induction assembly illustrated in FIG. 3.
Figure 5:
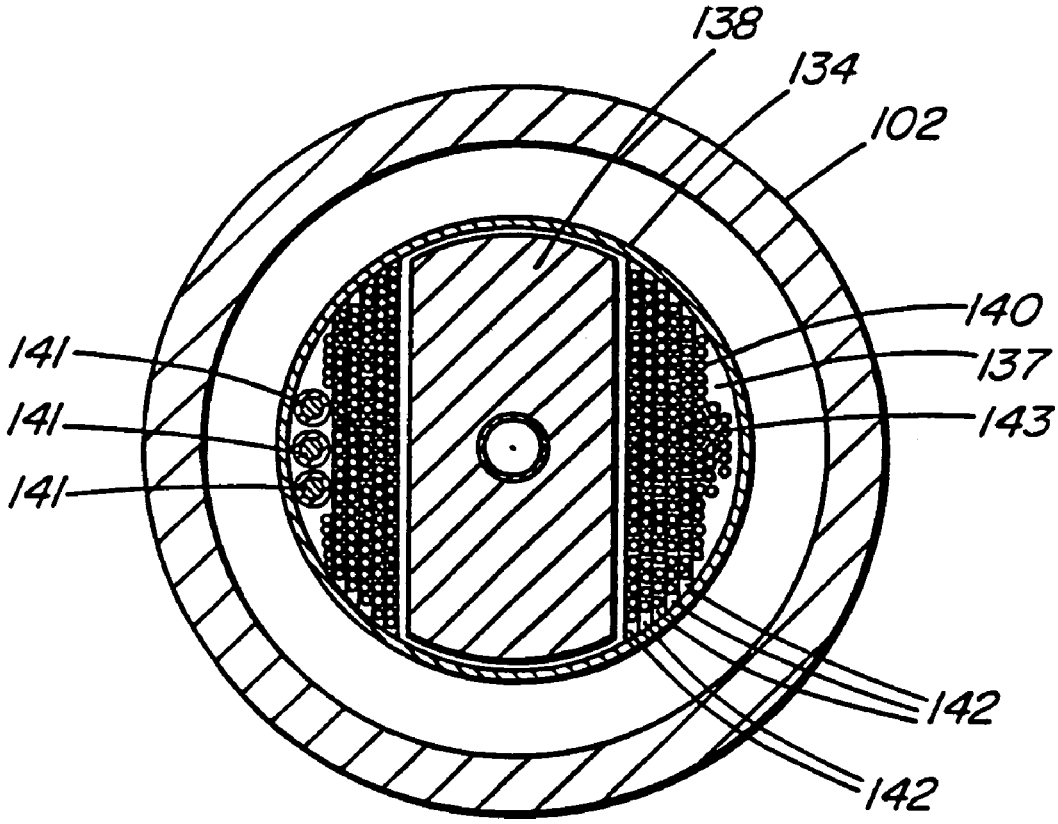
FIG. 5 is a diagrammatic plan cross-sectional view, taken along section lines V-V of the magnetic induction apparatus illustrated in FIG. 4.

Each magnetic induction apparatus 111 has a tubular housing 134 (FIGS. 4 and 5). Housing 134 may be magnetic or non-magnetic depending upon whether it is desirable to build up heat in the housing itself. Housing 134 has external centralizer members 136 (FIG. 6) and a magnetically permeable core 138 is disposed in housing 134. Electrical conductors 140 are wound in close proximity to core insulated dividers 142 which are used for electrically isolating the electrical conductors 140. Housing 134 has may be filled with an insulating liquid, which may be transformed to a substantially incompressible gel 137 so as to form a permanent electrical insulation and provide a filling that will increase the resistance of housing 134 to the high external pressures inherent in the well 100. The cross sectional area of magnetic core 138, the number of turns of conductors 140, and the current originating from the power control unit (PCU) may be selected to release the desired amount of heat when stimulated with a fluctuating magnetic field at a frequency such that no substantial net mechanical movement is created by the electromagnetic waves. Power conducting wires 141 and signal conducting wires 143 are used to facilitate connection with the PCU. For reduced heat release, a lower frequency, fewer turns of conductor, lower current, or less cross sectional area or a combination will lower the heat release per unit of length. Sections of inductor constructed in this fashion allow the same current to pass from one magnetic inductor apparatus 111 to another.

Figure 16:
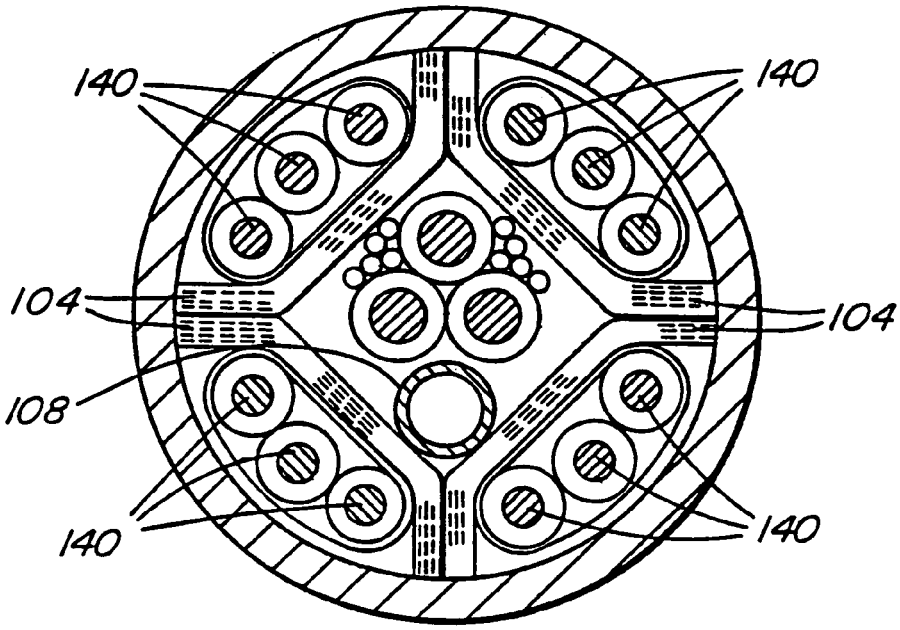
FIG. 16, appearing with FIG. 14, is an end sectional view of a first alternative internal configuration for the magnetic induction apparatus according to the invention.
Figure 17:
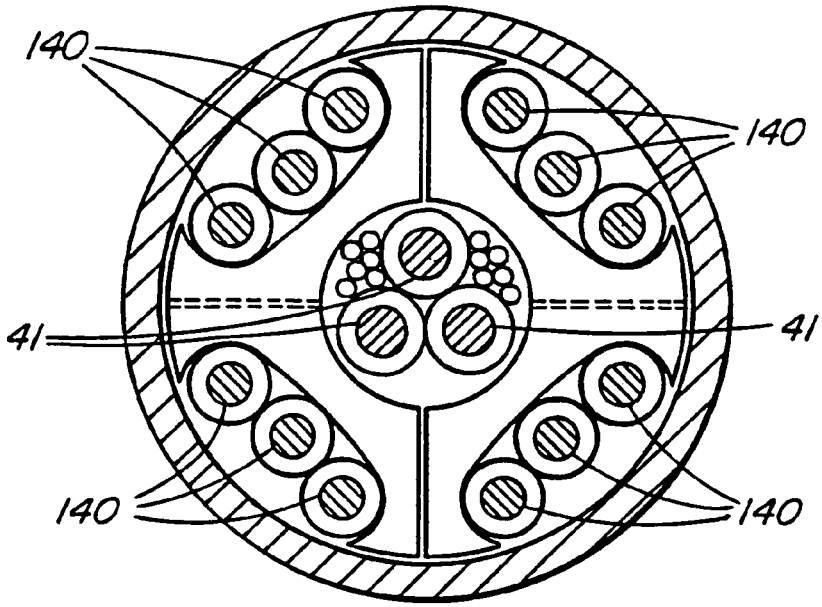
FIG. 17 is an end sectional elevation view of a second alternative internal configuration for the magnetic induction apparatus according to the invention.
Figure 18:
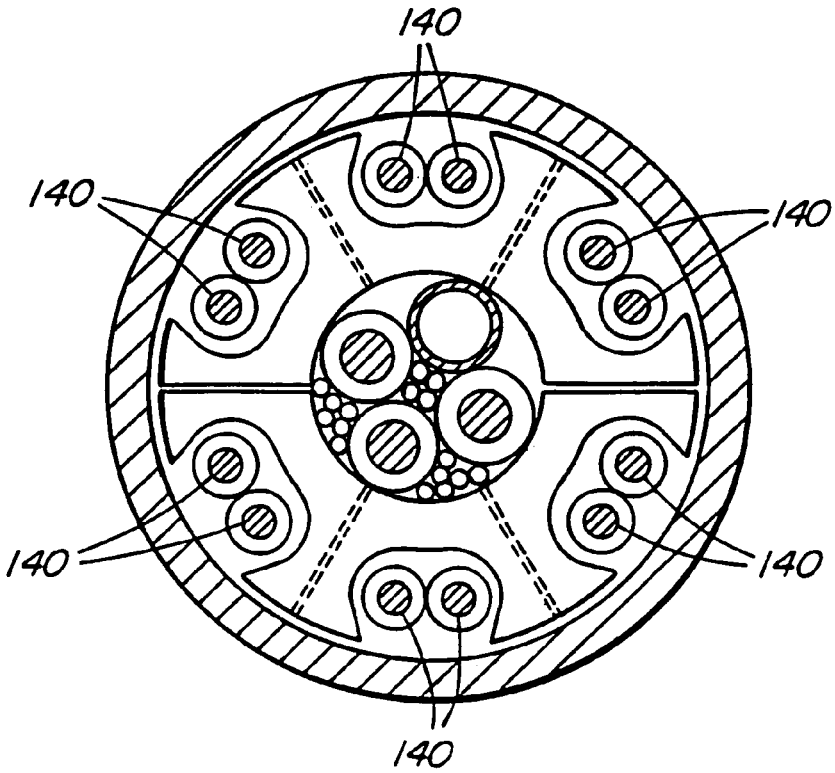
FIG. 18 is an end sectional view of a third alternative internal configuration for the magnetic induction apparatus according to the invention.

FIGS. 16, 17 and 18 illustrate alternative internal configurations for electrical conductors 140 and core 138 but are not intended to limit the various configurations possible. Where close fitting of inductor poles to the casing or liner is practical, additional magnetic poles may be added to the configuration with single or multiple phase wiring through each to suit the requirements. A number of inductors (i.e., core 138 with electrical conductors 140) may be contained in housing 134 with an overall length to suit the requirements and or shipping restraints. A multiplicity of housings 134 may connect several magnetic induction apparatuses 111 together to form a magnetic induction assembly 126. These induction apparatuses 111 may be connected with flanged and bolted joints or with threaded ends similar in configuration and form to those used in the petroleum industry for completion of oil and gas wells. At each connection for magnetic induction apparatus 111, there is positioned a conductive coupling 132. Conductive coupling 132 may consist of various mechanical connectors and flexible lead wires.

Figure 13:
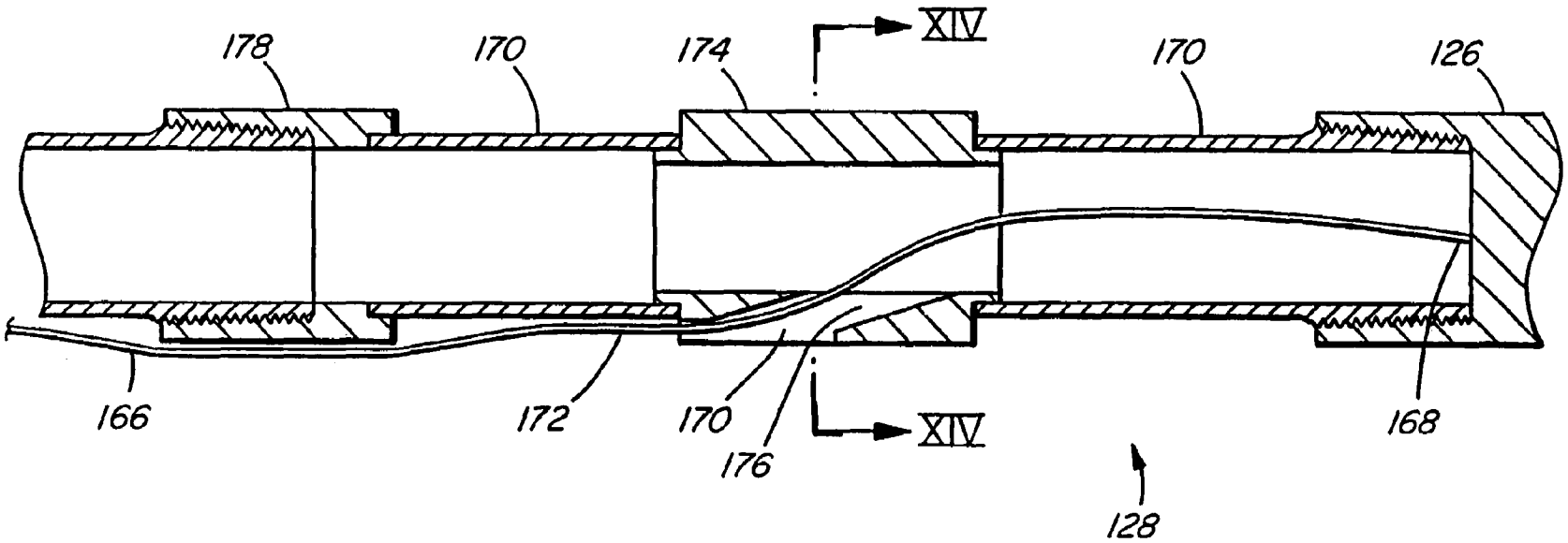
FIG. 13 is a side sectional view of the adapter sub of the magnetic induction assembly illustrated in FIG. 3.
Figure 14:
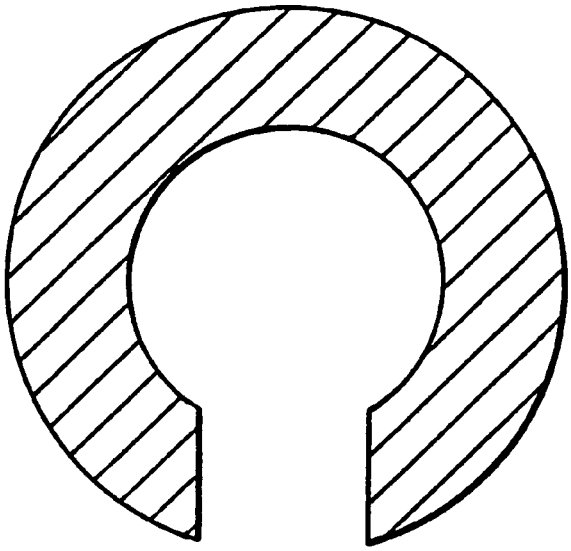
FIG. 14 is an end sectional view taken along lines XIV-XIV of FIG. 13.

The adapter sub 128 (FIG. 13) allows a cable, conveniently electrical submersible pump(ESP) cable 166, to be fed into top 168 of magnetic induction assembly 126 although other types of cables are available. Adapter sub 128 comprises a length of tubing 170 which has an enlarged section 174 near the midpoint such that the ESP cable 166 may pass through tubing 170 and transition to outer face 172 of tubing 70 by passing through a passageway 76 in enlarged section 174. Adapter sub 128 has a threaded coupling 178 to which the wellbore tubulars (not shown) may be attached thereby suspending magnetic induction assembly 126 at the desired location and allowing retrieval of the magnetic induction assembly 126 by withdrawing the wellbore tubulars.

Figure 6:
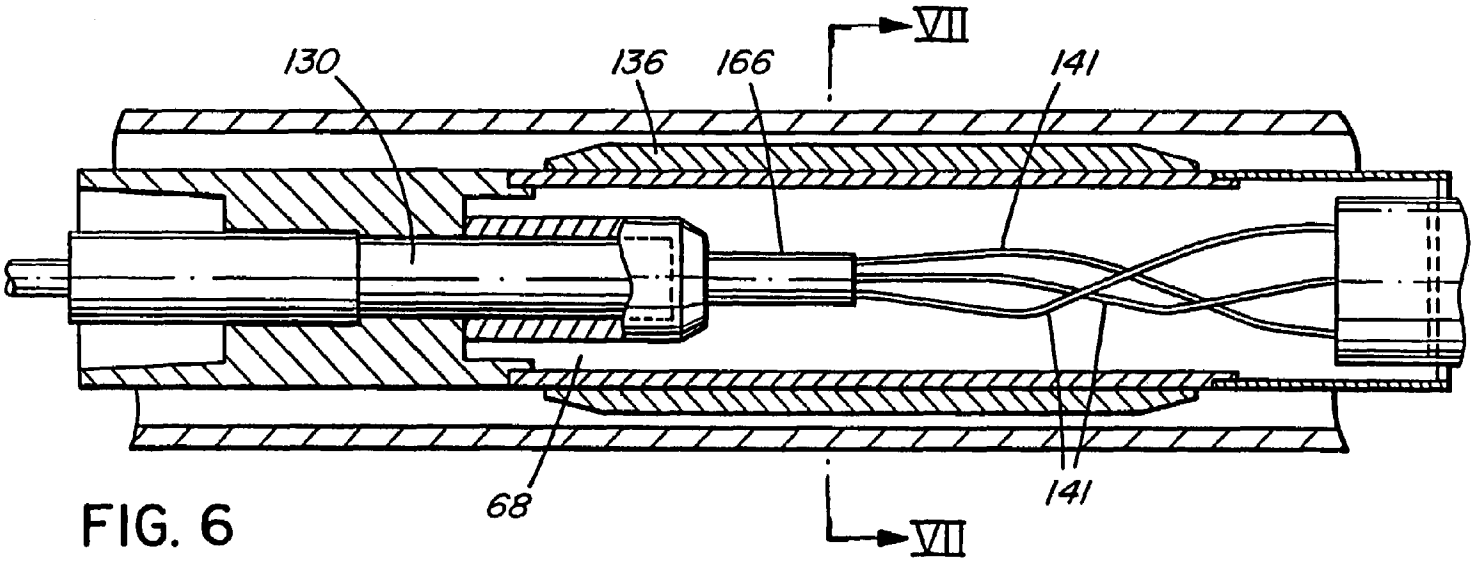
FIG. 6 is a diagrammatic side, cross-sectional view of the primary electrical connection from the magnetic induction assembly illustrated in FIGS. 3 and 4.
Figure 7:
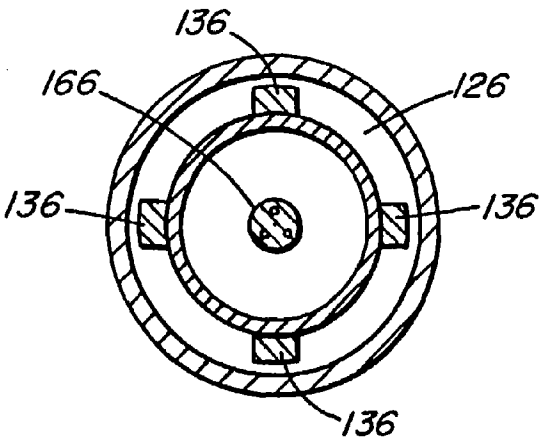
FIG. 7 is a diagrammatic end cross-sectional view, taken along section lines VI-VI of the primary electrical connection illustrated in FIG. 6.
Figure 8:
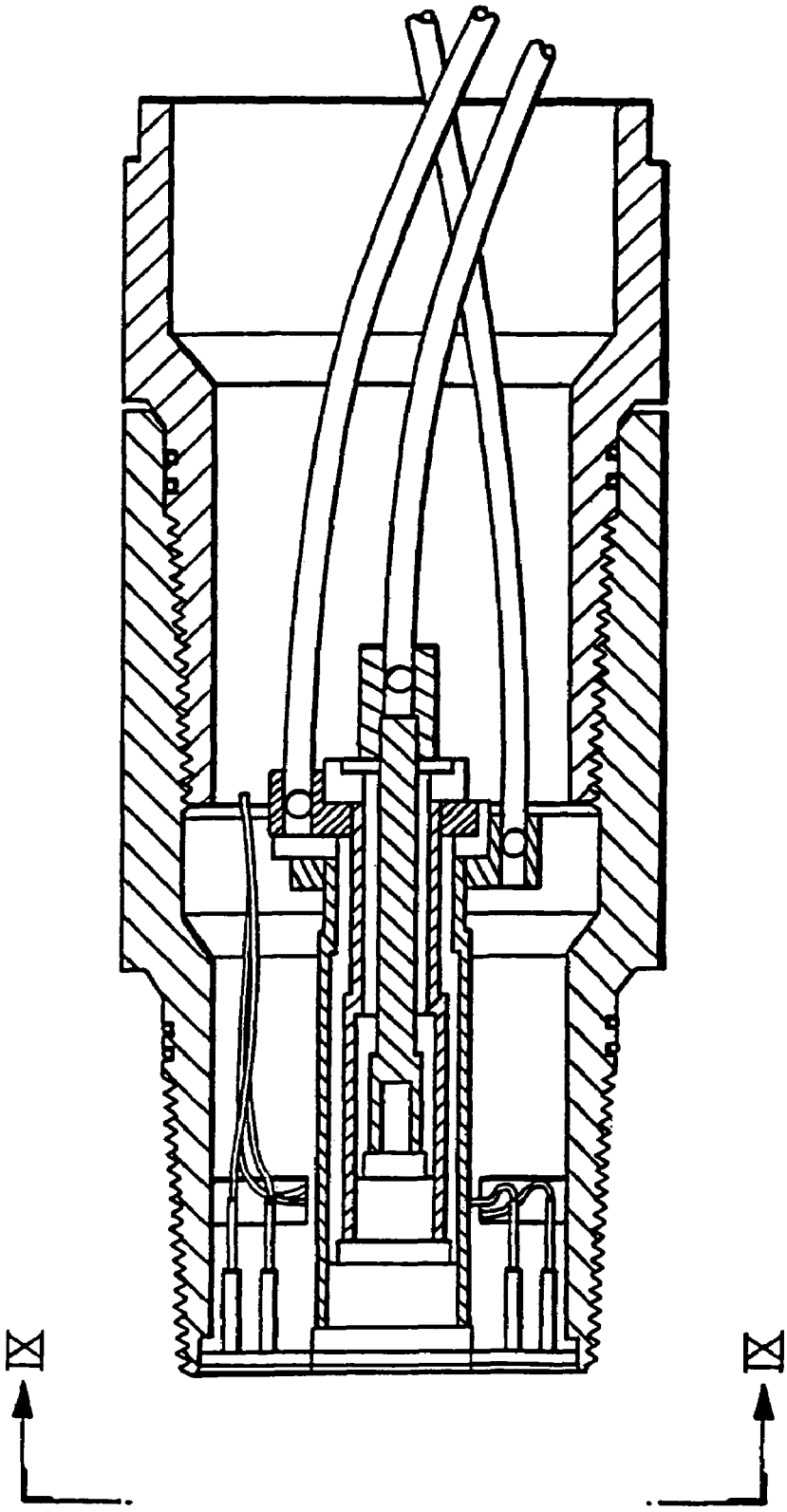
FIG. 8 is a diagrammatic partial side cross-sectional view of the male portion of the conductive coupling from the magnetic induction assembly illustrated in FIG. 3.
Figure 9:
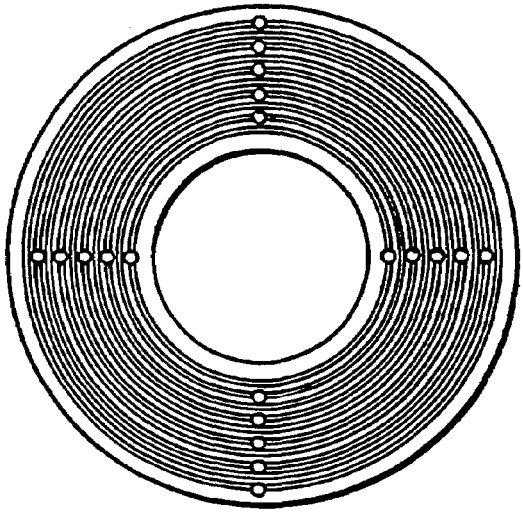
FIG. 9 is an end elevation view of the male portion of the conductive coupling illustrated in FIG. 8 taken along IX-IX of FIG. 8.
Figure 10:
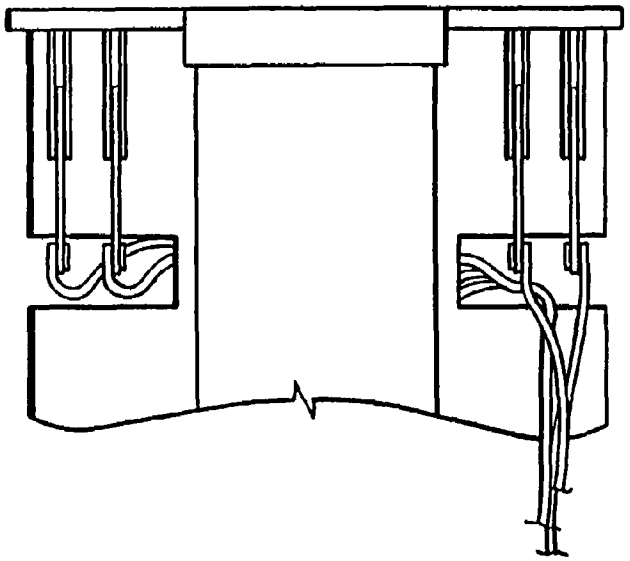
FIG. 10 is a side elevation sectional view of a portion of the male portion of the conductive coupling illustrated in FIG. 8.
Figure 11:
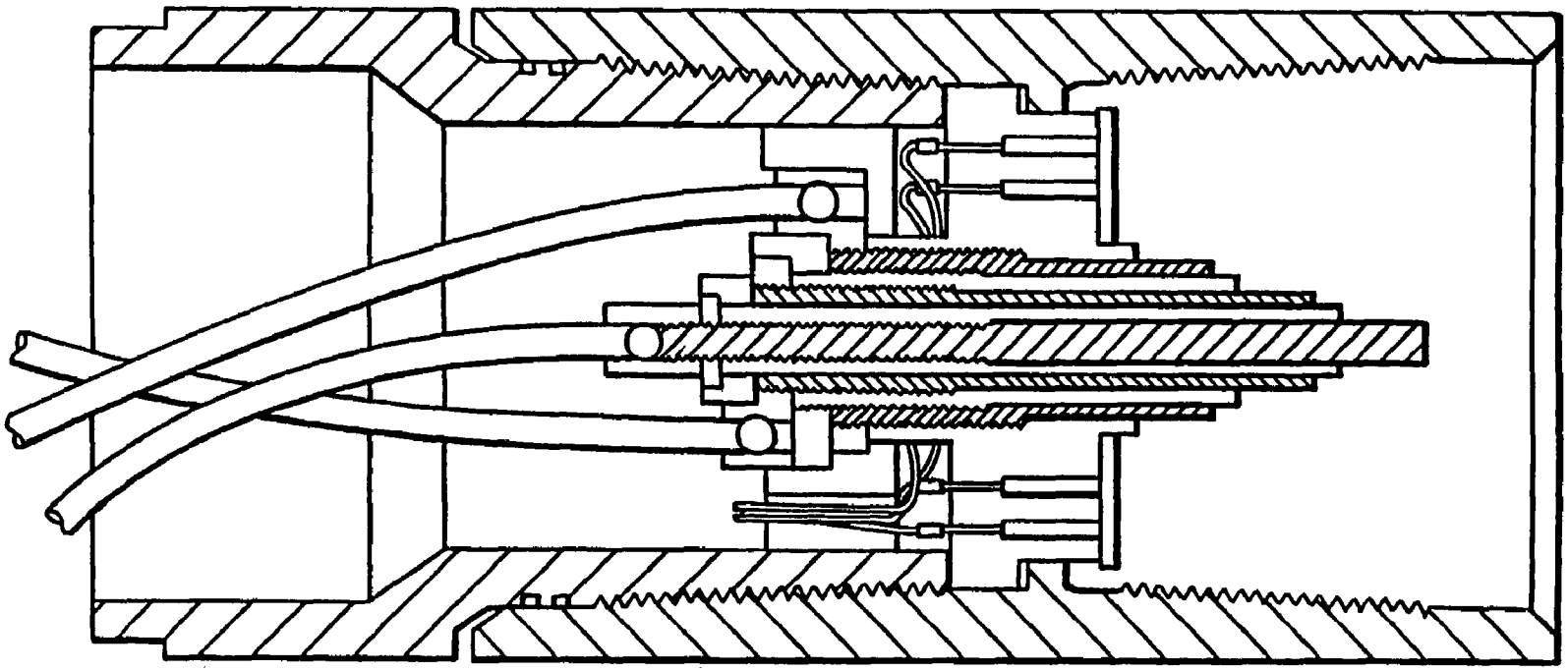
FIG. 11 is a side sectional view of a female portion of the conductive coupling of the magnetic induction assembly illustrated in FIG. 3.
Figure 12:
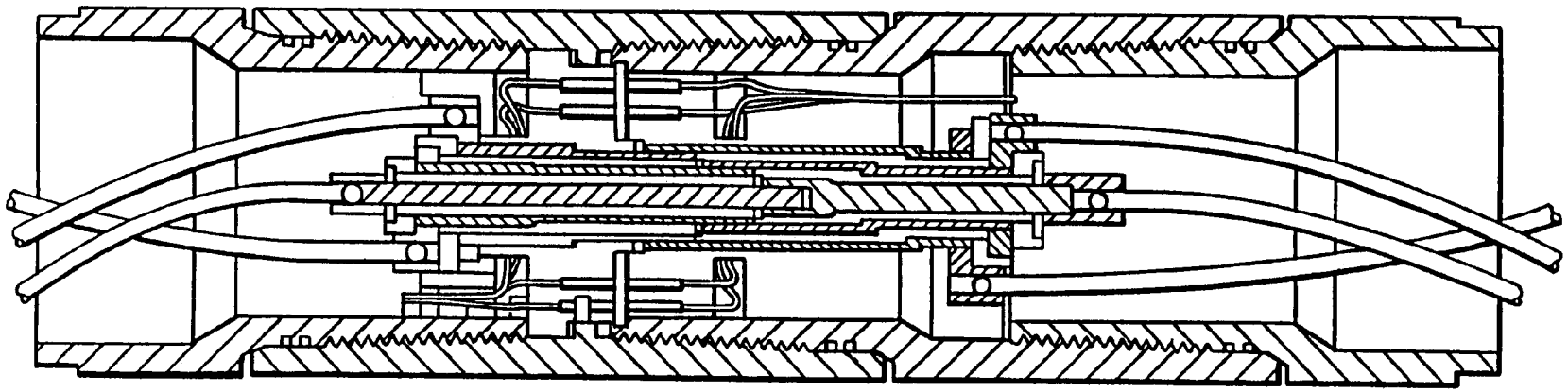
FIG. 12 is a side sectional view of the male portion illustrated in FIG. 8, coupled with the female portion illustrated in FIG. 11.

ESP cable 166 is coupled to an uppermost end 168 of magnetic induction assembly 126 by means of electrical feed through assembly 130 (FIG. 6). These assemblies are specifically designed for connecting cable to cable, cable through a wellhead, and cable to equipment and the like. The connection may also be made through a fabricated pack-off comprised of a multiplicity of insulated conductors with gasket packing compressed in a gland around the conductors so as to seal formation fluids from entering the inductor container. Electrical feed through assembly 130 has the advantage that normal oil field thread make-up procedures may be employed thus facilitating installation and retrieval. Use of a standard power feed allows standard oil field cable splicing practice to be followed when connecting to the ESP cable from magnetic induction assembly 126 to surface.

Figure 15:
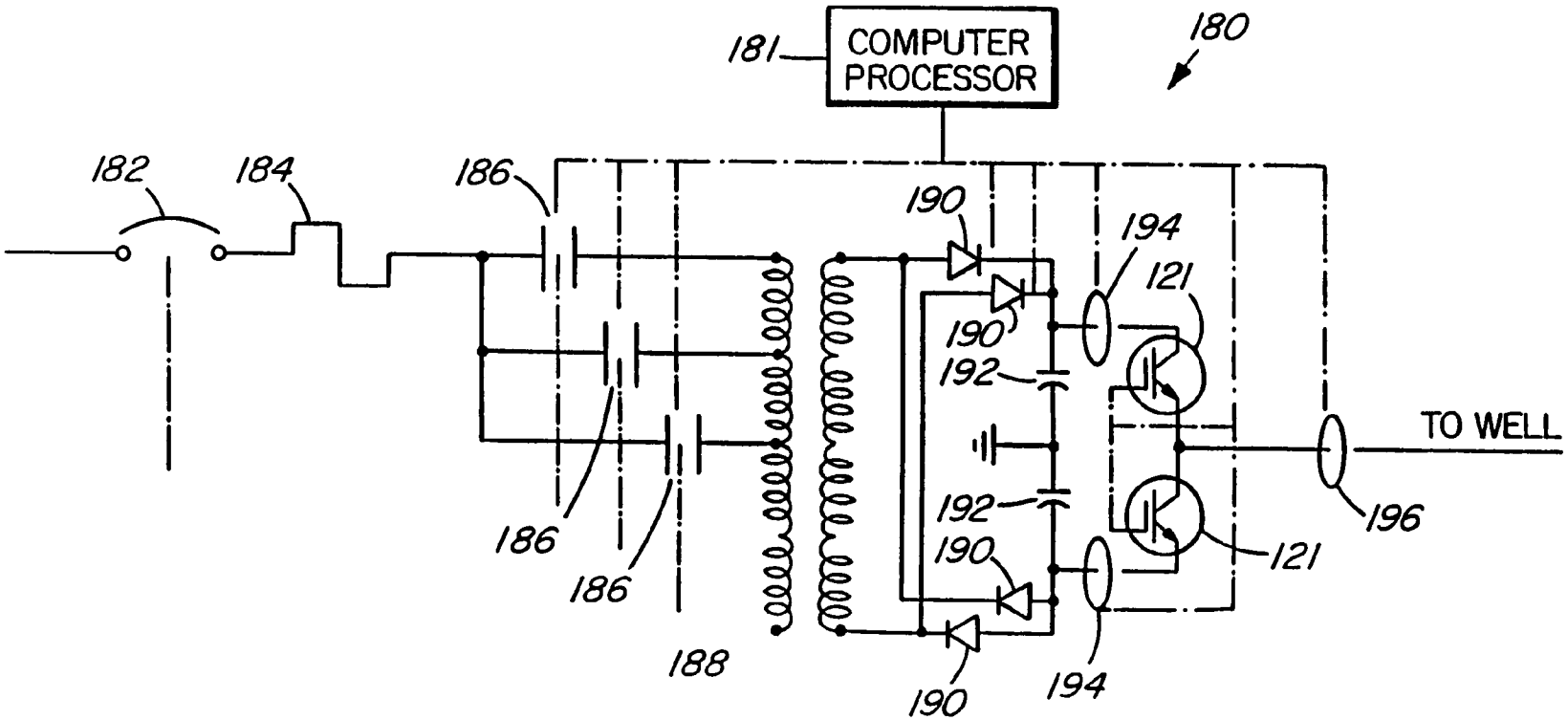
FIG. 15 is a schematic of a power control unit used with the magnetic induction assembly according to the invention.
Figure 19:
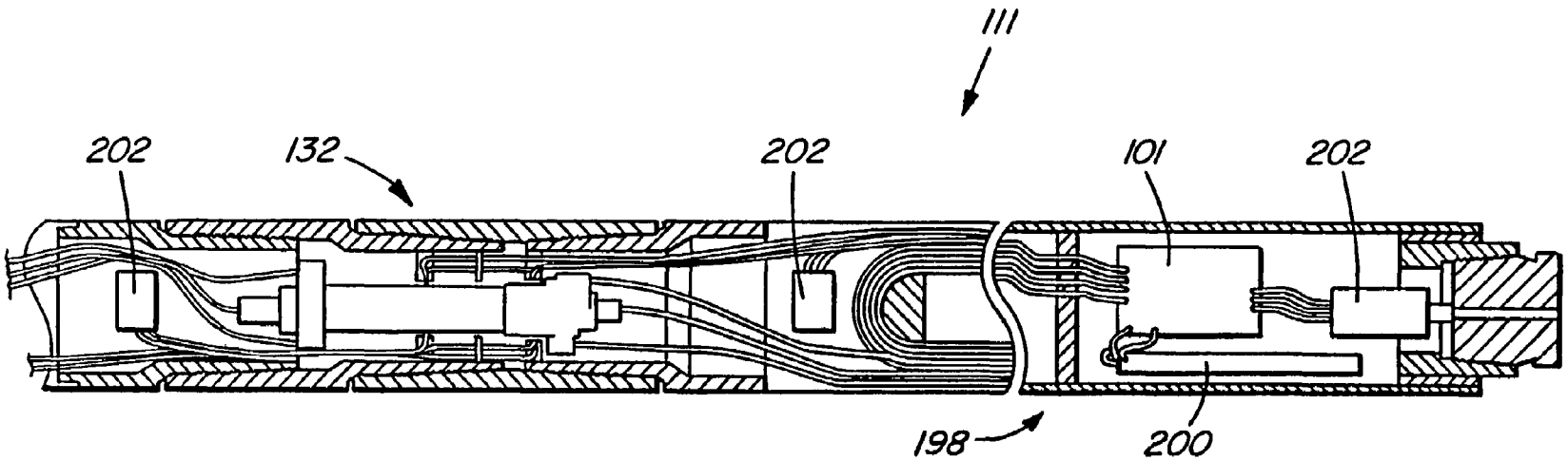
FIG. 19 is a diagrammatic side elevation sectional view of the instrument and sensor components used with the magnetic induction assembly according to the invention.

Magnetic induction assembly 126 works in conjunction with a power conditioning unit (PCU) 180 located at the surface or other desired location (FIG. 3). PCU 180 utilizes single and multiphase electrical energy either as supplied from electrical systems or portable generators to provide modified output waves for magnetic induction assembly 126. The output wave selected is dependent upon the intended application but square wave forms have been found to be most beneficial in producing heat. Maximum inductive heating is realized from waves having rapid current changes (at a given frequency) such that the generation of square or sharp crested waves are desirable for heating purposes. The PCU 180 has a computer processor 181 (FIG. 15). It is preferred that PCU 180 includes a solid state wave generating device such as silicon controlled rectifier(SCR) or insulated gate bipolar transistor(IGBT) 121 controlled from an interactive computer based control system in order to match system and load requirements. One form of PCU 180 may be configured with a multi tap transformer, SCR or IGBT and current limit sensing on-off controls. The preferred system consists of an incoming breaker, overloads, contactors, followed by a multitap power transformer, an IGBT or SCR bridge network and micro-processor based control system to charge capacitors to a suitable voltage given the variable load demands. The output wave should then be generated by a micro-controller. The micro-controller can be programmed or provided with application specific integrated circuits, in conjunction with interactive control of IG13T and SCR, control the output electrical wave so as to enhance the heating action. Operating controls for each phase include antishoot through controls such that false triggering and over current conditions are avoided and output wave parameters are generated to create the in situ heating as required. Incorporated within the operating and control system is a data storage function to record both operating mode and response so that optimization of the operating mode may be made either under automatic or manual control. PCU 180 includes a supply breaker 182, overloads 184, multiple contactors 186 (or alternatively a multiplicity of thyristors or insulated gate bipolar transistors), a multitap power transformer 188, a three phase IGBT or comparable semiconductor bridge 190, a multiplicity of power capacitors 192, IGST 121 output semiconductor anti shoot through current sensors 194, together with current and voltage sensors 196. PCU 180 delivers single and multiphase variable frequency electrical output waves for the purpose of heating, individual unidirectional output wave, to one or more of magnetic induction apparatuses 111, such that the high current in rush of a DC supply can be avoided. PCU 180 is equipped to receive the downhole instrument signals interpret the signals and control operation in accordance with program arid set points. PCU 180 is connected to the well head with ESP cable 166, which may also carry the information signals (FIG. 3). An instrument device 198 is located within each magnetic induction apparatus 111 (FIG. 19) for the purpose of receiving AC electrical energy from the inductor supply, so as to charge a battery 200, and which, on signal from PCU 180, commences to sense, in a sequential manner, the electrical values of a multiplicity of transducers 202 located at selected positions along magnetic induction apparatus 111 such that temperatures and pressures and such other signals as may be connected at those locations may be sensed and as part of the same sequence. One or more pressure transducers may be sensed to indicate pressure at selected locations and the instrument outputs a sequential series of signals which travel on the power supply wire(s) to the PCU wherein the signal is received and interpreted. Such information may then be used to provide operational control and adjust the output and wave shape to affect the desired output in accordance with control programs contained within the PCU computer and micro controllers.

OPERATION

Figure 1:
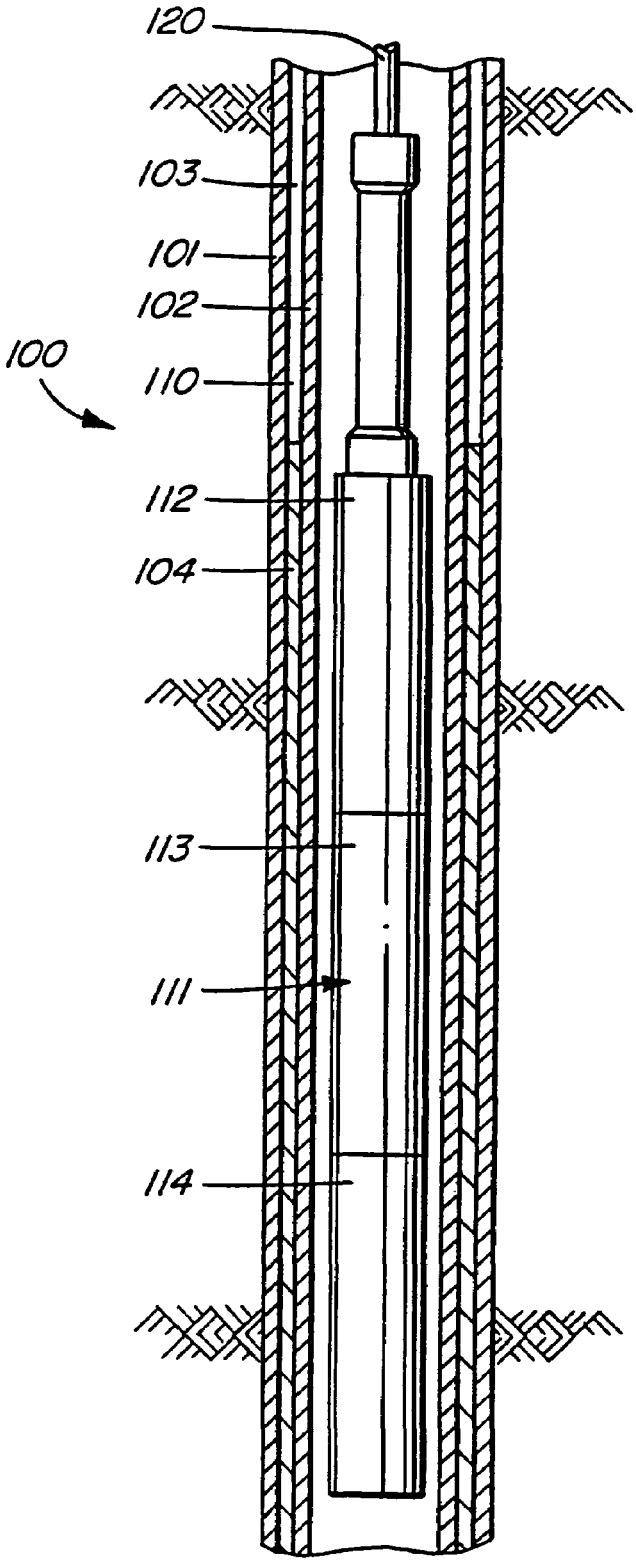
FIG. 1 is diagrammatic cross-sectional view of an oil or gas well particularly illustrating the location of the eutectic metal and the induction apparatus according to one aspect of the invention.

In operation and with initial reference to FIGS. 1 and 2, the eutectic metal, conveniently solder and being in the form of BB's or shot 104, is inserted into the annulus 110 by way of injection port line 103 which has allows installation of the shot 104 to a desired position within the annulus 110. The solder shot 104 is inserted into the annulus 110 to such an extent that the annulus is filled with the shot 104 for a predetermined distance above the well cement 115 as best illustrated in FIG. 2. Radioactive tracer elements can conveniently be added to the shot 104 thereby allowing standard well logging equipment to determine whether the correct location of the shot 104 has been reached and whether it is of consistent thickness or depth around the annulus 110.

Thereafter, the electrical induction heating apparatus 111 is lowered into position within the production casing and its operation is initiated (FIG. 1) as heretofore described. The heat generated by the induction apparatus 111 is transmitted through the production casing 102 to the shot 104 and melts the eutectic metal 104. This timing period can be calculated so that the required melting time period is reached and the temperature of the production casing to obtain such melting can be determined.

Following the melting of the shot 104 and, therefore, the sealing of the annulus 110 above the cement 115 between the surface and production casings 101, 102, the operation of the electrical induction apparatus 111 is terminated and the apparatus 111 is removed from the production casing 102. Any leakage through anomalies 116 in the cement 115 is intended to be terminated by the now solid eutectic metal 104. Of course, additional metal may be added if desired or required. The use of the induction apparatus 111 to generate heat reduces the inherent risk due to the presence of combustible hydrocarbons.

A eutectic metal mixture, such as tin-lead solder 104, is used because the melting and freezing points of the mixture is lower than that of either pure metal in the mixture and, therefore, melting and subsequent solidification of the mixture may be obtained as desired with the operation of the induction apparatus 111 being initiated and terminated appropriately. This mixture also bonds well with the metal of the production and surface casings 102, 101. The addition of bismuth to the mixture can improve the bonding action. Other additions may have the same effect. Other metals or mixtures may well be used for different applications depending upon the specific use desired.

In a further embodiment of the invention, it is contemplated that a material other than a metal and other than a eutectic metal may well be suitable for performing the sealing process.

For example, elemental sulfur and thermosetting plastic resins are contemplated to also be useful in the same process. In the case of both sulfur and resins, pellets could conveniently be injected into the annulus and appropriately positioned at the area of interest as has been described. Thereafter, the solid material is liquified by heating. The heating is then terminated to allow the liquified material to solidify and thereby form the requisite seal in the annulus between the surface and production casing. In the case of sulfur pellets, the melting of the injected pellets would occur at approximately 248 deg. F. Thereafter, the melted sulfur would solidify by terminating the application of heat and allowing the subsequently solidified sulfur to form the seal. Examples of typical thermosetting plastic resins which could conveniently be used would be phenol-formaldehyde, urea-formaldehyde, melamine-formaldehyde resins and the like.

Likewise, while the heating process described in detail is one of electrical induction, it is also contemplated that the heating process could be accomplished with the use of electrical resistance which could assist or replace the electrical induction technique. Indeed, any heating technique could usefully be used that will allow the solid material positioned in the annulus to melt and flow into a tight sealing condition and, when the heating is terminated, allow the material to cool thereby forming the requisite seal. The use of pressure within the annulus might also be used to affect and to initiate the polymerization process when thermosetting resins are being used. For example, high pressure nitrogen or compressed air could be injected into the annulus to increase the pressure in order to enhance the polymerization process.

Many additional modifications will readily occur to those skilled in the art to which the invention relates and the specific embodiments described should be taken as illustrative of the invention only and not as limiting its scope as defined in accordance with the accompanying claims.

I claim:

1. Method for melting a material in an annulus between the surface and production casing of an oil or gas well, said method comprising positioning said material at a predetermined location in said annulus and applying heat to said material, melting said material by said application of said heat and terminating said application of said heat following said melting of said material thereby to allow said material to solidify within said annulus and to form a seal within said annulus.

2. Method as in claim 1 wherein said material is a thermosetting resin.

3. Method as in claim 1 wherein said material is sulfur.

4. Method as in claim 1 wherein said heat is applied by electrical induction.

5. Method as in claim 1 wherein said heat is applied by electrical resistance.

6. Method as in claim 1 wherein said predetermined location is determined by adding tracer elements to said material and obtaining the position of said tracer elements in said annulus.

7. Method as in claim 1 wherein the melting of said material is affected by the use of pressure applied within said annulus.

8. Method as in claim 7 wherein said pressure is applied by compressed air or pressurised nitrogen injected into said annulus and maintained at a pressure within said annulus.

9. Apparatus for melting material in an annulus between the production and surface casing of an oil or gas well, said apparatus comprising an opening to allow the injection of said material into said annulus and to assume a predetermined location within said annulus, heating apparatus to apply heat to said material at said predetermined location within said annulus and to melt said material within said annulus and a switch to initiate and terminate said application of said heat to said material.

10. Apparatus as in claim 9 wherein said heating apparatus is an electrical induction heating apparatus.

11. Apparatus as in claim 9 wherein said heating apparatus in an electrical resistance heating apparatus.

12. Apparatus as in claim 9 wherein said material is a thermosetting resin.

13. Apparatus as in claim 9 wherein said material is sulfur.

14. Apparatus as in claim 9 and further comprising a supply of compressed gas to provide gas to said annulus.

15. Apparatus as in claim 14 wherein said compressed gas is nitrogen and/or air.

* * * * *